United States Patent [19]

Shimoichi

[11] Patent Number: 4,901,555

[45] Date of Patent: Feb. 20, 1990

[54] HEMMING APPARATUS

[75] Inventor: Koji Shimoichi, Hiroshima, Japan

[73] Assignee: Hiroshima Press Kogyo Co., Ltd., Hiroshima, Japan

[21] Appl. No.: 245,664

[22] Filed: Sep. 19, 1988

[30] Foreign Application Priority Data

Jul. 6, 1988 [JP] Japan ..... 63-168128

[51] Int. Cl.[4] ..... B21D 5/04; B23P 11/00

[52] U.S. Cl. ..... 72/322; 72/306; 29/243.58

[58] Field of Search ..... 72/306, 323, 322, 319, 72/320; 29/243.58, 243.57, 243.5

[56] References Cited

U.S. PATENT DOCUMENTS

| | | | |
|---|---|---|---|
| 2,937,689 | 5/1960 | Peterson | 72/320 |
| 3,143,095 | 8/1964 | Tribe | 29/243.58 |
| 3,595,061 | 7/1971 | Bessho | 72/319 |

FOREIGN PATENT DOCUMENTS

| | | | |
|---|---|---|---|
| 384575 | 11/1923 | Fed. Rep. of Germany | 72/320 |
| 917026 | 12/1946 | France | 72/319 |
| 45218 | 4/1981 | Japan | 72/319 |
| 206525 | 9/1986 | Japan | 72/320 |

*Primary Examiner*—Daniel C. Crane

*Attorney, Agent, or Firm*—Cushman, Darby & Cushman

[57] ABSTRACT

A hemming apparatus for hemming the peripheral part of a work usable for a motorcar in the form of a door, a bonnet or the like includes a lower anvil on which the work is placed, an upper anvil adapted to support the peripheral part of the work from the above, a presser for supporting the peripheral part of the work from the lower side, a link arm of which one end is operatively connected to the lower end of a second hydraulic cylinder, a shaft of the link arm being turnably supported at a middle part thereof by a frame, a preliminary bending punch for primarily preliminarily bending the peripheral part of the work and a main bending punch for secondarily bending the peripheral part of the work. The lower end of the preliminary bending punch is operatively jointed to the link arm via a joint member at one end of the ink arm, while the lower end of the main bending punch is operatively jointed to the link arm via a joint member at an opposite end of the same. A lifter is used for placing on the lower anvil the work which is conveyed by suitable conveying means. The lifter may serve also as a presser using a plate on which the presser and the lower anvil are mounted.

2 Claims, 7 Drawing Sheets

HEMMING APPARATUS

BACKGROUND OF THE INVENTION

1. Field of the Invention

The present invention relates to a hemming apparatus and more particularly to an apparatus for hemming the peripheral part of a work piece in the form of a door, a bonnet or the like usable for a motorcar.

2. Description of the Prior Art

To facilitate understanding of the present invention, it will be helpful that a conventional hemming apparatus will be described with reference to FIG. 7 which illustrates an example of an apparatus for hemming the peripheral part of a work such as a door, a bonnet or the like usable for a mortorcar. Referring to the drawing, a lower die half 61 includes a hemming die 63 on which a work W conveyed by conveying means (not shown) is set. In addition, it includes a york 66 which is supported turnable about a shaft 65 secured to a bracket 64 fixedly mounted on a base board 62.

In the drawing, reference numeral 68 designates an upper die half in which a movable frame 69 is slidably accomodated. The movable frame 69 is provided with a presser 70 for firmly holding the work W. Additionally, a main bending punch 72 extending in parallel with the presser 70 is secured to the lower end surface of a die holder 71 made integral with the upper die half 68, and moreover a cam 73 adapted to come in engagement with a cam follower **66*a* during lowering movement of the upper die half 68 is secured to the lower end surface of the die holder 71. Incidentally, reference numeral 74 designates a spring which imparts a thrusting force to the presser 70 under the effect of compression during lowering movement of the upper die half 68, reference numeral 75 does a pin which serves for operatively connecting the movable frame 69 to the upper die half 68 while preventing the movable frame 69 from falling from the upper die half 68, reference numeral 76 does a member made integral with the movable frame 69 for firmly holding the work W during hemming operation, reference numeral 77 does a pin and reference numeral 78 does a guide member for guiding upward and downward movements of the movable frame 69**.

With such construction, when the upper die half 68 is lowered by operating pressing means (not shown), the peripheral parts W of two sheet-shaped works W of which edges are superposed one above another are firmly held by the presser 70 which has been lowered. Thereafter, a series of pressing operations are performed in accordance with the order of forward movement of the preliminary bending punch 67 for the purpose of preliminary bending, backward movement of the same and lowering movement of the main bending punch 72 for the purpose of final bending operation.

As will be apparent from the above description, the conventional hemming apparatus is divided into the upper die half and the lower die half to assure that a work is placed on the upper surface of the lower die half, and the upper die half is lowered onto the lower die half. Indeed, the upper die half is provided with a presser and a main bending punch and the lower die half is provided with a preliminary bending punch. The preliminary bending punch is constructed to operate under the effect of engagement with a cam mechanism secured to the upper die half. Further, a timing for hemming operations to be performed is set in view of a mechanical connective relationship among the presser, preliminary bending punch and main bending punch. Due to such construction as mentioned above, the conventional apparatus has drawbacks that it becomes complicated in structure, it is made at an expensive cost, there is a need of providing work conveying means adapted to move in and out of a clearance between both the upper and lower die halves, and it is restricted with respect to configuration, dimensions, operation timing and others. Another drawback is that it is difficult to adjust a timing with respect to the presser, preliminary bending punch and main bending punch.

SUMMARY OF THE INVENTION

The present invention has been made with the foregoing background in mind and its object resides in providing a hemming apparatus which requires hemming means only on the lower side relative to a work to be hemmed and assures that a timing during hemming operation is set using hydraulic cylinders and a link mechanism.

Other object of the present invention is to provide a hemming apparatus which assures that a work is easily conveyed in and out of the apparatus and the latter is simply constructed in smaller dimensions.

Another object of the present invention is to provide a hemming apparatus which assures that it is operated exactly and reliably.

To accomplish the above objects, there is provided according to one aspect of the present invention a hemming apparatus comprising a lower anvil on which a work having a peripheral part comprising a plurality of superposed sheet materials to be hemmed is placed with the aid of conveying means, the lower anvil being secured to a frame, an upper anvil secured to the foremost end of a movable body disposed slidable along a guide member secured to the frame to support the peripheral part of the work from the above, the upper anvil being adapted to move from its inoperative position after the work is placed on the lower anvil, a presser of which base end is operatively connected to the uppermost end of a piston rod of a first hydraulic cylinder disposed on the frame, the presser being adapted to support the peripheral part of the work from the lower side by displacement of the uppermost end of the piston rod, a link arm of which one end is operatively connected to the lowermost end of a piston in a second hydraulic cylinder secured to the frame, a shaft located at the middle of the link arm being turnably supported by the frame, a preliminary bending punch disposed slidable relative to the frame and operatively connected to the link arm at a position located in the proximity of the one end thereof to primarily preliminarily bend the peripheral part of the work by displacement of the foremost end of the preliminary bending punch, and a main bending punch disposed slidable relative to the frame and operatively connected to the link arm at an opposite end thereof to secondarily bend the peripheral part of the work by displacement of the foremost end of the main bending punch.

Further, there is provided according to other aspect of the present invention a hemming apparatus comprising a lifter serving as conveying means for a work having a peripheral part comprising a plurality of superposed sheet materials to be hemmed, a lower anvil on which the work is placed from the lifter, an upper anvil for supporting the work from the above, the upper anvil being adapted to move from its inoperative position after the work is placed on the lower anvil, a presser adapted to support the peripheral part of the work on the lower anvil from the lower side, a link arm of which one end is operatively connected to the lowermost end of a piston rod of a second hydraulic cylinder, a shaft located at the middle of the link arm being turnably supported by the frame, a preliminary bending arm disposed slidable relative to the frame and operatively connected to the link arm at a position located in the proximity of one end thereof to primarily preliminarily bend the peripheral part of the work by displacement of the foremost end of the preliminary bending punch, and a main bending punch disposed slidable relative to the frame and operatively connected to an opposite end of the link arm to secondarily bend the peripheral part of the work by displacement of the foremost end of the main bending punch, wherein the bottom surface of the presser and the bottom surface of the lower anvil are fixedly located flush with the upper surface of a plate constituting the lifter, the plate being connected to the upper end of a piston rod of a first hydraulic cylinder.

Other objects, features and advantages of the present invention will become readily apparent from reading of the following description which has been made in conjunction with the accompanying drawings.

BRIEF DESCRIPTION OF THE DRAWINGS

The present invention will be illustrated in the following drawings in which.

DESCRIPTION OF THE PREFERRED EMBODIMENTS

Now, the present invention will be described in a greater detail hereunder with reference to the accompanying drawings which illustrate preferred embodiments thereof.

Figure 1:
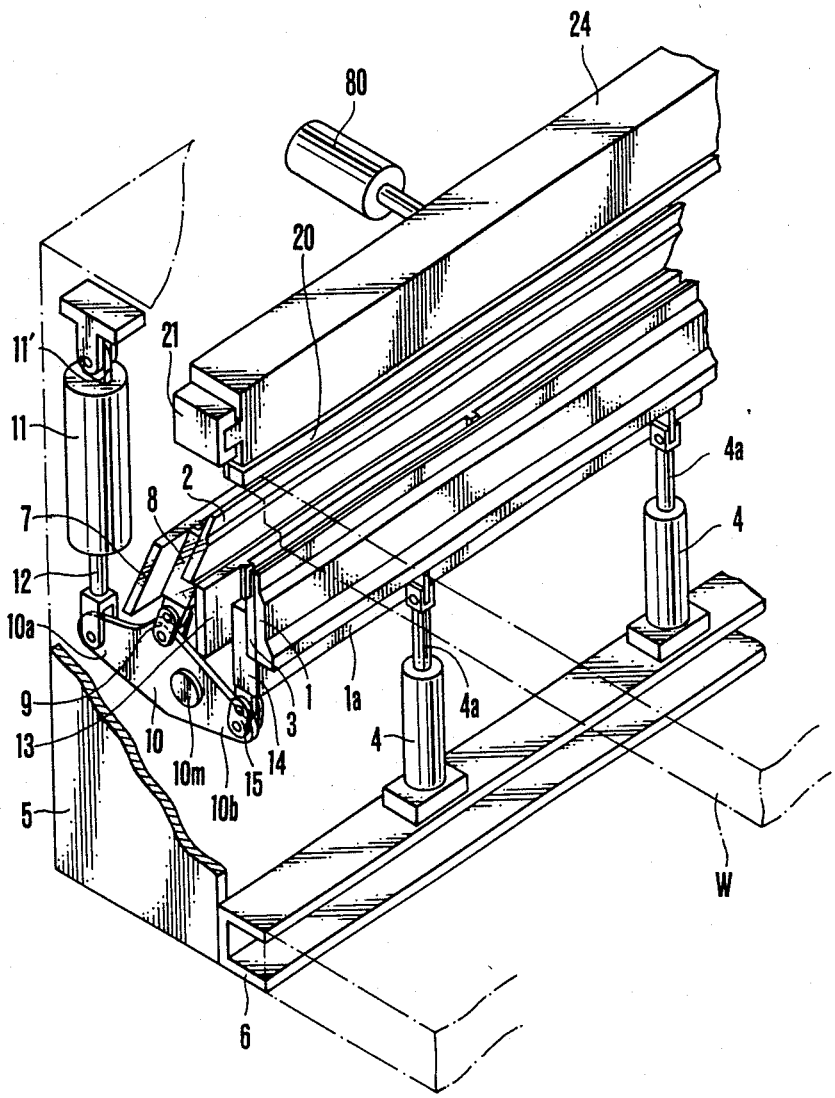
FIG. 1 is a partially exploded perspective view of a hemming apparatus in accordance with a first embodiment of the present invention.
Figure 2:
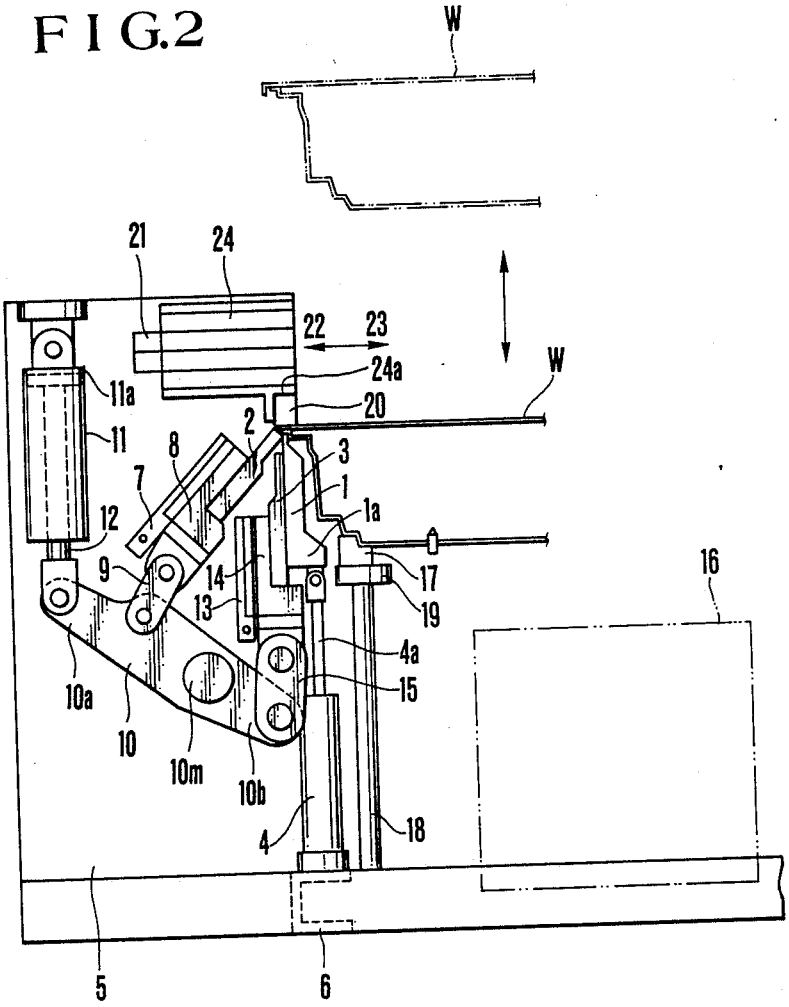
FIG. 2 is a fragmental vertical sectional view of the hemming apparatus in FIG. 1 during hemming operation.

In FIGS. 1 and 2, reference numeral 1 designates a presser adapted to support a work W around its periphery from the lower side during hemming operation, reference numeral 2 does a preliminary bending punch for preliminarily bending the peripheral part of the work W and reference numeral 3 does a main bending punch for finally bending the peripheral portion of the work W. The uppermost end of the presser 1 comes in pressure contact with the peripheral part of the work W to support it which will be subjected to hemming later. On the other hand, the bottom end 1*a* of the presser 1 is operatively connected to the upper end of a piston 4*a* of a first hydraulic cylinder 4. As will be apparent from the drawings, the first hydraulic cylinder 4 stands upright on an U-shaped beam 6 which is made integral with the floor portion of the frame 5.

The preliminary bending punch 2 is secured to a supporting member 8 which is slidably arranged on a stationary member 7 which in turn is secured to the frame 5. The supporting member 8 is operatively jointed to a link arm 10 via a joint member 9 at a position located in the proximity of the left-hand end of the link arm 10 as viewed in FIG. 2. The link arm 10 is supported to turn about a shaft 10*m* which is secured to the frame 5. The left-hand end of the link arm 10 is operatively connected to the lower end of a piston 12 of a second hydraulic cylinder 11. The base end 11*a* of the second hydraulic cylinder 11 is pivotally secured to the ceiling surface of the frame 5.

The main bending punch 3 is secured to a supporting member 14 which is slidably arranged on a stationary member 13 which in turn is secured to the frame 5. The supporting member 14 is operatively jointed to a right-hand end 10*b* of the link arm 10 via a joint member 15.

In FIG. 2, reference numeral 16 designates a lifter of which detailed structure is not shown in the drawing. The lifter 16 is provided independently of the floor portion of the frame 5 so as to permit it to expand and contract freely. Specifically, the lifter 16 constitutes a mechanism for receiving a work W which is conveyed by suitable conveying means when it assumes an expanded attitude.

A lower anvil 17 is a member which is fixedly mounted on a plate 19 with the aid of a foot 18 standing upright on the floor portion of the frame 5 in order to receive the work W from the lifter 16 so as to allow it to be placed thereon, while an upper anvil 20 is a member adapted to firmly hold the work W on the lower anvil 17 from the above. The upper anvil 20 is detachably fitted to the outer peripheral part 24*a* of a movable body 24 which is slidable along guide 21 secured to the frame 5 in both directions as represented by arrow marks 22 and 23 under the control of a driving power source (not shown) for a hydraulic cylinder 80 (see FIG. 1 . When the work W is to be placed on the lower anvil 17, the upper anvil 20 is caused to move away from its operative position in the direction as represented by the arrow mark 22, and when the work W is subjected to hemming, it moves in the direction of the arrow mark 23 so as to allow the work W to be depressed from the upper side.

Next, description will be made below as to how hemming operation is performed in accordance with the first embodiment.

A position assumed by the frame 5 having the presser 1, the preliminary bending punch 2, the main bending punch 3, the lower anvil 17 and the upper anvil 20 secured directly or indirectly thereto is changed in dependence on the kind of work W such as a door for 2-door type motorcar, a door for 4-door type motorcar, a bonnet or the like, and a work W is then placed on the lower anvil 17.

While the upper anvil 20 is kept at its inoperative position where it is displaced in the direction of the arrow mark 22 (see FIG. 2) after arrangement of the frame 5 is adjusted in response to the aforementioned changing of the kind of work, the work W is received from the conveying means onto the lifter 16 which has been expanded and it is then placed on the lower anvil 17 as the lifter 16 is lowered. Next, the upper anvil 20 is displaced in the direction of the arrow mark 23 (see FIG. 2) so that the work W is supported from the above.

Figure 3:
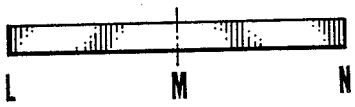
FIG. 3 is a schematic view illustrating positions assumed by a piston during operation of a second hydraulic cylinder.
Figure 4A:
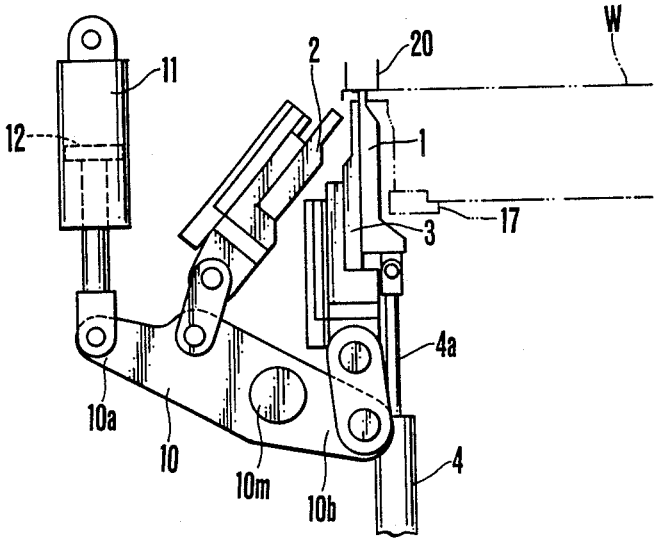
FIGS. 4A to 4C are a fragmental enlarged view of the hemming apparatus respectively, particularly illustrating a manner of operation of a preliminary bending punch and a main bending punch.
Figure 4B:
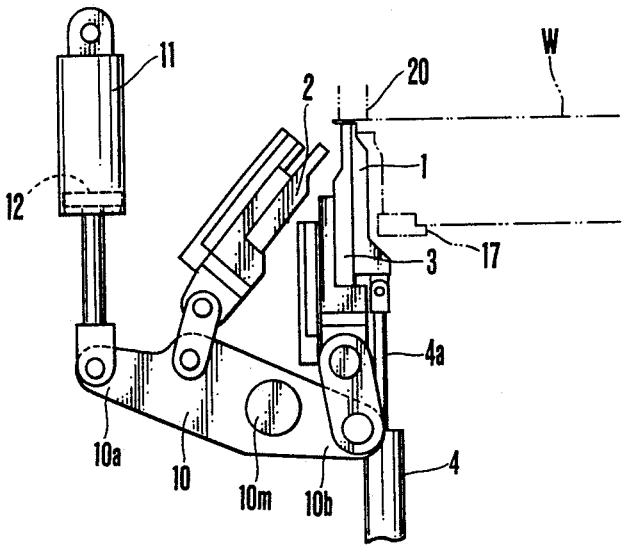
Figure 4C:
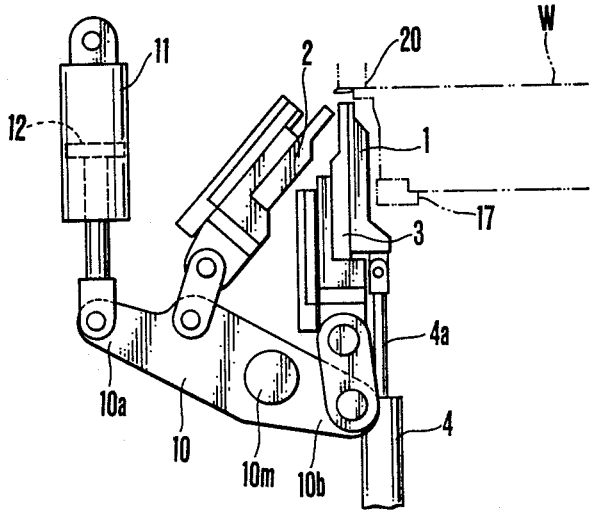

Next, by activating the first hydraulic cylinder 4, the presser 1 is displaced upwardly so that the peripheral part of the work W to be subjected to hemming is firmly supported from the lower side (see FIG. 4A). While this operative state is maintained, a piston 12 in the second hydraulic cylinder 11 is retracted whereby the uppermost end of the piston 12 is displaced to a position L from an operative starting position M as shown in FIG. 3. As a result, the left-hand end 10*a* of the link arm 10 is turned about the shaft 10*m* of the link arm 10 in the clockwise direction. This permits the preliminary bending punch 2 to primarily preliminarily bend the peripheral part of the work W, as shown in FIG. 2. During this preliminary bending operation, the right-hand end 10*b* of the link arm 10 is also caused to turn about the shaft 10*m* of the link arm 10 in the clockwise direction. Accordingly, the uppermost end of the main bending punch 3 is located remote from the peripheral part of the work W. Next, the piston 12 in the second hydraulic cylinder 11 is protruded to assume a position N in FIG. 3. Consequently, the right-hand end 10*b* of the link arm 10 is caused to turn about the shaft 10*m* of the link arm 10 in the anticlockwise direction with the result that the preliminary bending punch 2 is displaced away from the peripheral part of the work W and at the same time the right-hand end 10*b* of the link arm 10 turns about the shaft 10*m* of the link arm 10 in the anticlockwise direction to secondarily bend the peripheral part of the work W until the required bending operation is completed, as shown in FIG. 4. Next, the piston 12 in the secondary hydraulic cylinder 11 is retracted so as to allow the uppermost end of the piston 12 to resume the operative starting position M. This causes both the main bending punch 3 and the preliminary bending punch 2 to be parted away from the peripheral part of the work W. Next, by activating the first hydraulic cylinder 4 to retract the piston 4*a*, the presser 1 is displaced away from the peripheral part of the work W (see FIG. 4C).

Next, description will be made below as to measures to be taken in a case where the kind of work W such as a door for 2-door type motorcar, a door for 4-door type motorcar, a bonnet or the like to be hemmed is changed successively. (1) Since width of the work W varies when the kind of work W is changed, there is a need of changing positional arrangement of the present embodiment for hemming the peripheral part of the work. (2) In addition, since dimensions of the peripheral part of the work W to be hemmed vary, there is a need of changing a position where the upper anvil 20 is secured to the movable body 24 or exchanging the existing upper anvil 20 with other one. (3) Additionally, since dimensions of the peripheral part of the work W to be hemmed vary, there is a need of carrying out adjustment with respect to a direction of movement of the foremost end of the preliminary bending punch 2 as well as adjustment with respect to a position where the presser 1 and the main bending punch 3 are fitted or exchanging the existent preliminary bending punch, presser and main bending punch with other ones. As means for solving a problem concerning the aforementioned changing, the present embodiment proposes that arrangements for a door for 2-door type motorcar, a door for 4-door type motorcar and a bonnet are previously provided and a certain arrangement is selectively substituted for the existent arrangement at every time when the kind of work W is changed.

This means for solving the foregoing problem has advantageous effects that since necessary components exclusive the presser, preliminary bending punch, main bending punch, lower anvil and upper anvil can be used in common, arrangements for a door for 2-door motorcar, a door for 4-door motorcar and a bonnet can be prepared at an inexpensive cost and a period of time required for changing the kind of work W can be reduced substantially.

Figure 5:
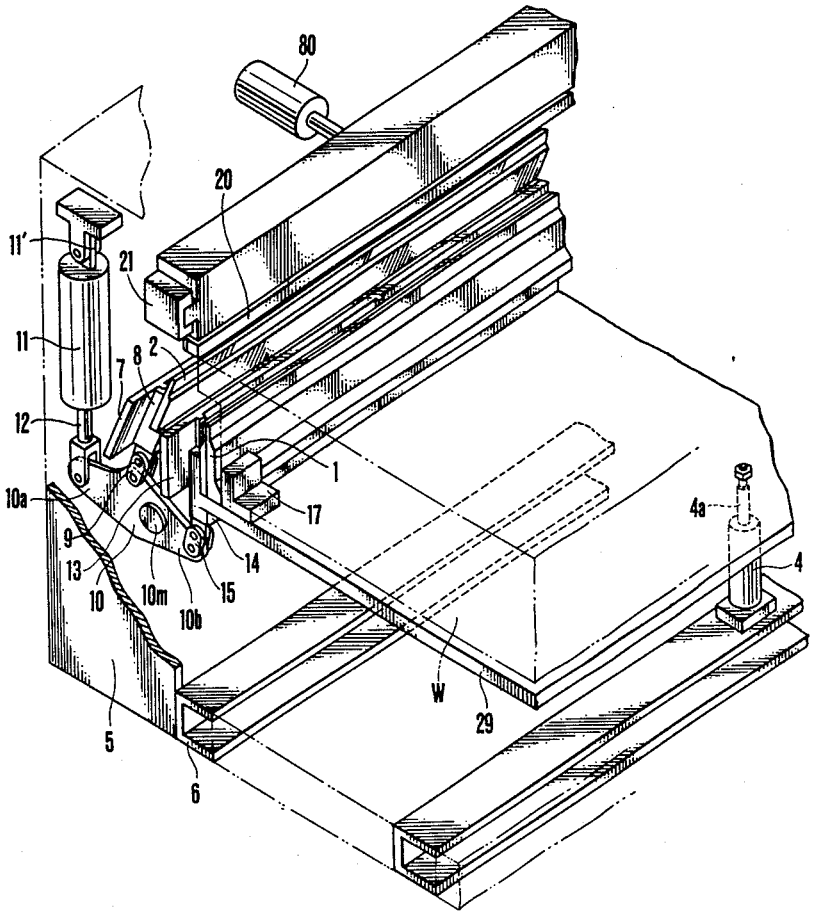
FIG. 5 is a partially exploded perspective view of a hemming apparatus in accordance with a second embodiment of the present invention.
Figure 6:
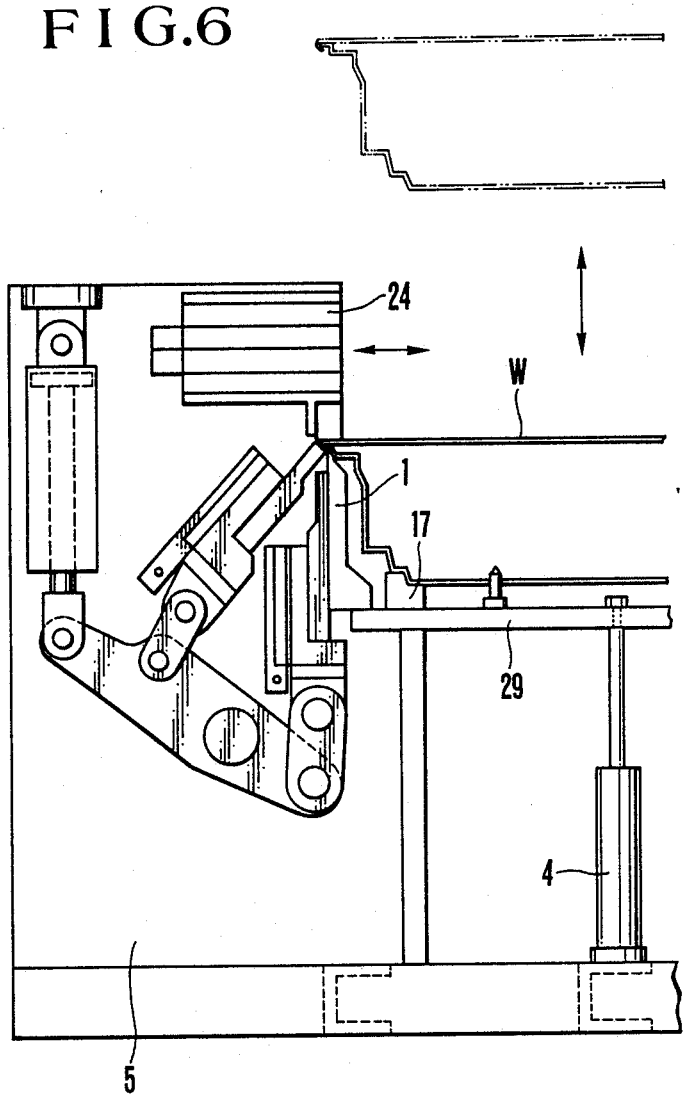
FIG. 6 is a fragmental vertical sectional view similar to FIG. 2, illustrating a manner of operation of the hemming apparatus in accordance with the second embodiment of the present invention.
Figure 7:
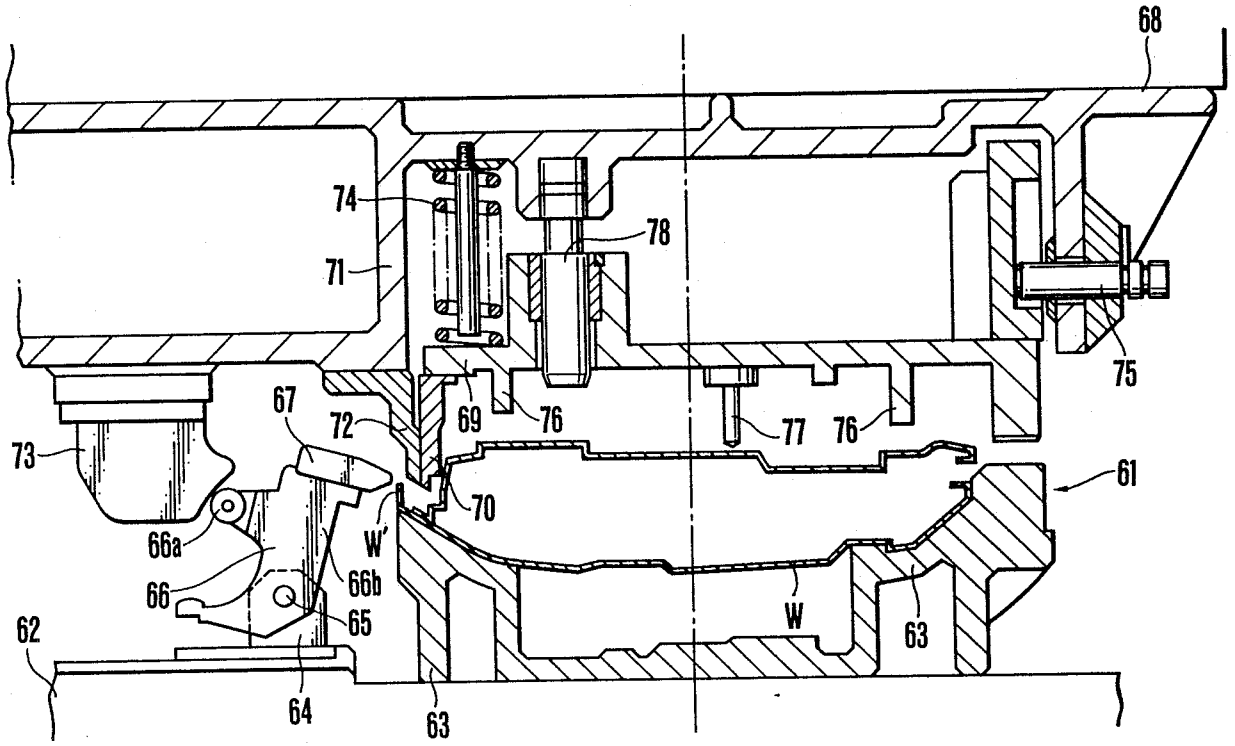
FIG. 7 is a vertical sectional view of a typical conventional hemming apparatus.

Next, a second embodiment of the present invention will be described below with reference to FIGS. 5 and 6. A different point between the first embodiment and the second embodiment consists in the following structure. Namely, the first embodiment is such that a presser section (comprising the presser 1 and the first hydraulic cylinder 4), a lower anvil section for works (comprising the lower anvil 17 and the plate 19) and a lifter 16 are constructed separately, while the second embodiment is such that both the presser 1 and the lower anvil 17 are secured to a plate 29 which in turn is integrally connected to the uppermost end of the piston 4*a* in the first hydraulic cylinder 4 by means of bolts and nuts.

With the foregoing construction, a hemming apparatus in accordance with the second embodiment is operated in the following order. (1) The plate 29 having the lower anvil 17 for a work W mounted on the surface thereof is raised up by activating the first hydraulic cylinder 4. (2) The lower anvil 17 receives the work W. (3) By activating the first hydraulic cylinder 4, the plate 29 is lowered until it assumes the lowest position where it is kept on standby. (4) The upper anvil 20 is displaced forwardly from its inoperative position. (5) By activating the first hydraulic cylinder 4 again, the presser 1 mounted on the plate 29 is raised up. Hereinafter, operations are performed in the same manner as in the first embodiment.

Since the hemming apparatus in accordance with the second embodiment is constructed such that the presser 1 acts also as a lifter 16, it has an advantageous effect that it can be made at an inexpensive cost. In addition, since the second embodiment is such that the presser 1 is constructed integral with a lifter adapted to receive a work and effect positioning therewith so as to allow the presser 1 to perform hemming operation, the apparatus serves as optimum hemming means at opposite positions with the work held therebetween.

As described above, a hemming apparatus of the present invention is constructed in such a manner that a presser, a preliminary bending punch and a main bending punch for performing hemming operation are provided on a single side with respect to a work to be hemmed. Consequently, it offers the following advantageous effects.

(1) The apparatus of the invention is different from the conventional one which is so constructed that it is divided into an upper die half and a lower die half and a work to be hemmed is placed on the lower die half. Accordingly, the apparatus becomes simple in structure and moreover a device for conveying works into and out of the apparatus can be designed easily.

(2) In addition, the apparatus of the invention is so constructed that a link arm is driven by means of a piston in a hydraulic cylinder and operation of the preliminary bending punch is shifted to operation of the main bending punch and vice versa. Consequently, structure of the apparatus can be simplificated and timing relative to punching operations can be set easily.

(3) Even in a case where the kind of works to be hemmed is successively changed like a case where a door for 2-door type motorcar, a door for 4-door type motorcar and a bonnet are successively subjected to hemming, the whole apparatus does not become expensive, because specific hemming arrangements are previously prepared for works in the form of a hemming apparatus for a single side or for both sides. In addition, a period of time required for changing the kind of works can be reduced remarkably.

(4) Additionally, the apparatus of the invention is so constructed that a frame is displaced in forward and rearward directions. A method of conveying works in and out of the apparatus can be practiced easily. Thus, hemming operation can be performed at an increased speed.

While the present invention has been described merely with respect to two preferred embodiments, it should of course be understood that it should not be limited only to them but various changes or modifications may be suitably made without departure from the scope of the invention as defined by the appended claims.

What is claimed is:

1. A hemming apparatus comprising:

a lower anvil on which a work having a peripheral part comprising a plurality of superposed sheet materials to be hemmed is placed with the aid of conveying means, said lower anvil being secured to a frame, an upper anvil secured to the foremost end of a movable body disposed slidable along a guide member secured to said frame to support said peripheral part of said work from above, said upper anvil being adapted to move from its inoperative position after the work is placed on the lower anvil, a presser of which base end is operatively connected to the uppermost end of a piston rod of a first hydraulic cylinder disposed on the frame, said presser being adapted to support the peripheral part of the work from the lower side by displacement of the uppermost end of the piston rod, a link arm of which one end is operatively connected to the lowermost end of a piston in a second hydraulic cylinder secured to the frame, a shaft mounted to the middle of said link arm and mounted to the frame, at least one of said link arm and said shaft being turntable relative to the frame, a preliminary bending punch operatively connected to the link arm at a position located in the proximity of said one end thereof so as to be slidable relative to the frame to primarily preliminarily bend the peripheral part of the work by displacement of the foremost end of said preliminary bending punch, and a main bending punch disposed slidable relative to the frame and operatively connected to the link arm at an opposite end thereof to secondarily bend the peripheral part of the work by displacement of the foremost end of said main bending punch, said preliminary bending punch and said main bending punch being located on said link arm so that an extended and retracted position of said second cylinder results in a sequential bending of said work and the formation of a hem on said work by said punches.

2. A hemming apparatus comprising:

a lifter serving as conveying means for a work having a peripheral part comprising a plurality of superposed sheet materials to be hemmed, a lower anvil on which said work is placed from said lifter, an upper anvil for supporting the work from the above, said upper anvil being adapted to move from its inoperative position after the work is placed on said lower anvil, a presser adapted to support said peripheral part of said work on the lower anvil from the lower side, a link arm of which one end is operatively connected to the lowermost end of a piston in a second hydraulic cylinder secured to the frame, a shaft mounted to the middle of said link arm and mounted to the frame, at least one of said link arm and said shaft being turnable relative to the frame, a preliminary bending punch operatively connected to the link arm at a position located in the proximity of said one end thereof so as to be slidable relative to the frame to primarily preliminarily bend the peripheral part of the work by displacement of the foremost end of said preliminary bending punch, and an main bending punch disposed slidable relative to the frame and operatively connected to an opposite end of the link arm to secondarily bend the peripheral part of the work by displacement of the foremost end of said main bending punch, said preliminary bending punch and said main bending punch being located on said link arm so that an extended and retracted position of said second cylinder results in a sequential bending of said work and the formation of a hem on said work by said punches, wherein the bottom surface of the presser and the bottom surface of the lower anvil are fixedly located flush with the upper surface of a plate constituting the lifter, said plate being connected to the upper end of a position rod of a first hydraulic cylinder.

* * * * *